US006540491B1

(12) United States Patent
Tanabe

(10) Patent No.: US 6,540,491 B1
(45) Date of Patent: Apr. 1, 2003

(54) ELECTROMAGNETIC RECIPROCATING COMPRESSOR

(75) Inventor: Masaaki Tanabe, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 0 days.

(21) Appl. No.: 09/890,045

(22) PCT Filed: Nov. 25, 1999

(86) PCT No.: PCT/JP99/06580

§ 371 (c)(1),
(2), (4) Date: Jul. 25, 2001

(51) Int. Cl.[7] ..... F04B 17/04
(52) U.S. Cl. ..... 417/417; 417/416
(58) Field of Search ..... 417/254, 416, 417/417, 419, 539

(56) References Cited

U.S. PATENT DOCUMENTS 2,732,124 A * 1/1956 Poliansky ..... 310/35
3,542,495 A * 11/1970 Barthalon ..... 310/24
4,012,675 A * 3/1977 Schulze, Jr. ..... 310/24
4,718,832 A 1/1988 Takahashi
5,222,878 A * 6/1993 Osada et al. ..... 417/417
6,382,935 B1 * 5/2002 Mikiya et al. ..... 417/413.1

FOREIGN PATENT DOCUMENTS

JP 55-40275 * 3/1980 ..... F04B/17/04
JP 61-207883 9/1986

* cited by examiner

*Primary Examiner*—Charles G. Freay
*Assistant Examiner*—Timothy P. Solak
(74) *Attorney, Agent, or Firm*—Pennie & Edmonds LLP

(57) ABSTRACT

There is provided a compressor having two compression portions arranged in parallel. A compression chamber is formed into an air-tight chamber surrounded by a head of a piston, a cylinder, and a head cover. A discharge chamber is provided to the periphery of each cylinder, and these discharge chambers communicate with each other by a through hole. Two field cores of each electromagnet for driving each piston are formed in the integral structure, and a half wave of an alternating electric current is supplied to each coil wound around these coils in such a manner that the excitation directions of the respective field cores are opposed from each other.

9 Claims, 7 Drawing Sheets

ELECTROMAGNETIC RECIPROCATING COMPRESSOR

CROSS REFERENCE TO RELATED APPLICATIONS

This is a 371 national stage Application of PCT Application No. PCT/JP99/06580, filed Nov. 25, 1999, which was not published under PCT Article 21(2) in English.

BACKGROUND OF THE INVENTION

1. Field of the Invention

The present invention relates to an electromagnetic reciprocating compressor, and more ii particularly to a compact electromagnetic reciprocating compressor with a high volume fluid discharge capacity.

2. Description of the Related Art

A conventional electromagnetic reciprocating compressor is provided with a piston having an integrally formed armature, a fixed electromagnet provided around the armature, and a spring for urging the piston in one direction, and driven by a half-wave-rectified alternating current. In operation, when the fixed electromagnet is excited by a half-wave electric current, the piston is moved by the electromagnetic effect of the armature and the electromagnet in a direction compressing the spring. Then, with a next half wave, the fixed magnet is demagnetized, and the piston is pushed back to return to its original position by the rebound effect of the spring. With the reciprocation of the piston in a compression chamber as described above, a fluid such as air is sucked into the compression chamber, compressed and discharged. In this type of compressor, the quantity of fluid discharged is determined by the dimensions of the compression chamber and the operation frequency the piston operates at.

When obtaining a larger discharge quantity by this type of compressor, coupling a plurality of compressors may be considered. For example, in the electromagnetic compressor disclosed in Jpn. Pat Appln. KOKAI publication No. 61-207883, a plurality of compressors are integrally coupled in a linear or radial form, and respective fluid passages of a plurality of compressors are connected in parallel, thereby increasing the discharge quantity.

The above-described electromagnetic reciprocating compressor has the following disadvantages. The discharge quantity can be increased by integrally coupling a plurality of compressors. However, this leads to an increase in overall size. For example, assuming that a compressor with a large discharge quantity in which a plurality of compressors are integrally incorporated is used as an outdoor blower, a drip-proof housing must be provided. In such a case, since the entire apparatus including the housing is increased in size and the installation place is restricted in particular, a reduction in size is demanded. Further, there is a disadvantage in the complicated connections needed. For example, much wirings must be gathered by using connectors in order to provide the electrical wiring between a plurality of compressors.

Furthermore, in order to prevent pulsation of a fluid discharged from the compressor from being transmitted to the outside, there is required an air tank for buffering, which temporarily accumulates the fluid discharged from the compressor. When a plurality of compressors are coupled to discharge a large quantity of fluid, the pulsation becomes prominent, and the air tank must have a large capacity in order to suppress this pulsation, which results in a further increase in size.

BRIEF SUMMARY OF THE INVENTION

In order to eliminate the above-described problems, it is an object of the present invention to provide a compact electromagnetic reciprocating compressor with a large discharge quantity which has a plurality of compression portions.

To achieve this aim, according to the present invention, there is provided an electromagnetic reciprocating compressor comprising: a casing; and a plurality of fluid compression portions which are arranged in the casing, each of which has a piston, and which are arranged in such a manner that these pistons move along directions parallel to each other. Each of these compression portions includes: a cylinder for accommodating therein the piston so as to be capable of reciprocating; a compression chamber defined by the piston for compressing a fluid in the cylinder; a spring for urging the piston in a direction for compressing the fluid in the compression chamber, one field core having a pair of opposed portions for forming magnetic poles oppositely-arranged along a diametral direction of the piston, a coil which is wound around the field core and moves the piston against the urging force of the spring when excited, and a discharge chamber for receiving the compressed fluid from the compression chamber when the coil is demagnetized. Moreover, the compressor comprises passaging means which are provided in the casing and communicates discharge chambers of the respective compression portions, the field core of each compression portion being integrally formed so as to commonly use a boundary portion with a field core of an adjacent compression portion, and a power supply device for supplying a half wave of an alternating electric current to the coil in such a manner that an excitation direction of at least one of a plurality of the field cores can be opposed to those of other field cores.

According to this compressor, the piston is moved in one direction by the electromagnetic effect of an armature and the coil for exciting the field core, and moved in an opposed direction by the spring means when the coils are demagnetized. The fluid is compressed/discharged in the compression chamber by the operation of this piston. Respective pistons of a plurality of the compression portions are arranged so as to be parallel to each other, and the field core is excited to drive each piston when an alternating half wave is supplied. Since the electric circuit means supplies an alternating electric current in such a manner that some of a plurality of field cores are excited in a direction opposed from those of other field cores, the pistons of some of a plurality of compression portions are moved in directions opposed to each other. Therefore, the vibrations generated cancel each other out, dissimilar to the case where the pistons simultaneously reciprocate, and the vibrations of the compressor are suppressed.

In addition, the boundary portion of the field cores can be commonly used by the adjacent compression portions. Additionally, the discharge chambers communicate with each other by the passage means, and the discharge chamber of the compression portion which is not in the discharge stroke is utilized as the compression chamber of the compression portion which is in the discharge stroke. Thus, the capacity of the discharge chamber is substantially increased, thereby reducing the pulsation.

Further, according to another aspect of the present invention, there is provided a blower which includes an electromagnetic reciprocating compressor in a housing. This compressor comprises: a casing; and a plurality of fluid compression portions which are arranged in the casing, each of which has a piston and which are arranged so that the pistons can move along directions parallel to each other, each of these compression portions having: a cylinder for accommodating therein the piston so as to be capable of reciprocating; a piston for defining a compression chamber for compressing a fluid; a spring for urging the piston in a direction for compressing the fluid in this compression chamber; one field core having a pair of opposed portions forming magnetic poles oppositely-arranged along the diametrical direction of the piston; a coil which is wound around the field core and moves the piston against the urging force of the spring when excited; and a discharge chamber for receiving the compressed fluid from the compression chamber when this coil is demagnetized. Furthermore, in this compressor, the field core of each compression portion is integrally-formed so as to be capable of commonly using a boundary portion with a field core of an adjacent compression portion. Moreover, the compressor comprises: a power supply for supplying a half wave of an alternating electric current to the coil in such a manner that at least one of a plurality of field cores has an excitation direction opposed from those of other field cores; and a head cover which covers the cylinder and is attached to the casing, defining the compression chamber in the cylinder with the piston, defines the discharge chamber having an air-tight structure at the outside of the each cylinder, and has a passage communicating the discharge chambers with each other and a nozzle protruding toward the outside and communicating the discharge chambers with the outside. In addition, the blower includes: a tank arranged in the housing; and a bush which is formed in the tank and accommodates the nozzle in the sealed state, and receives the fluid compressed in each compression chamber into the tank.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

DETAILED DESCRIPTION OF THE INVENTION

Figure 1:
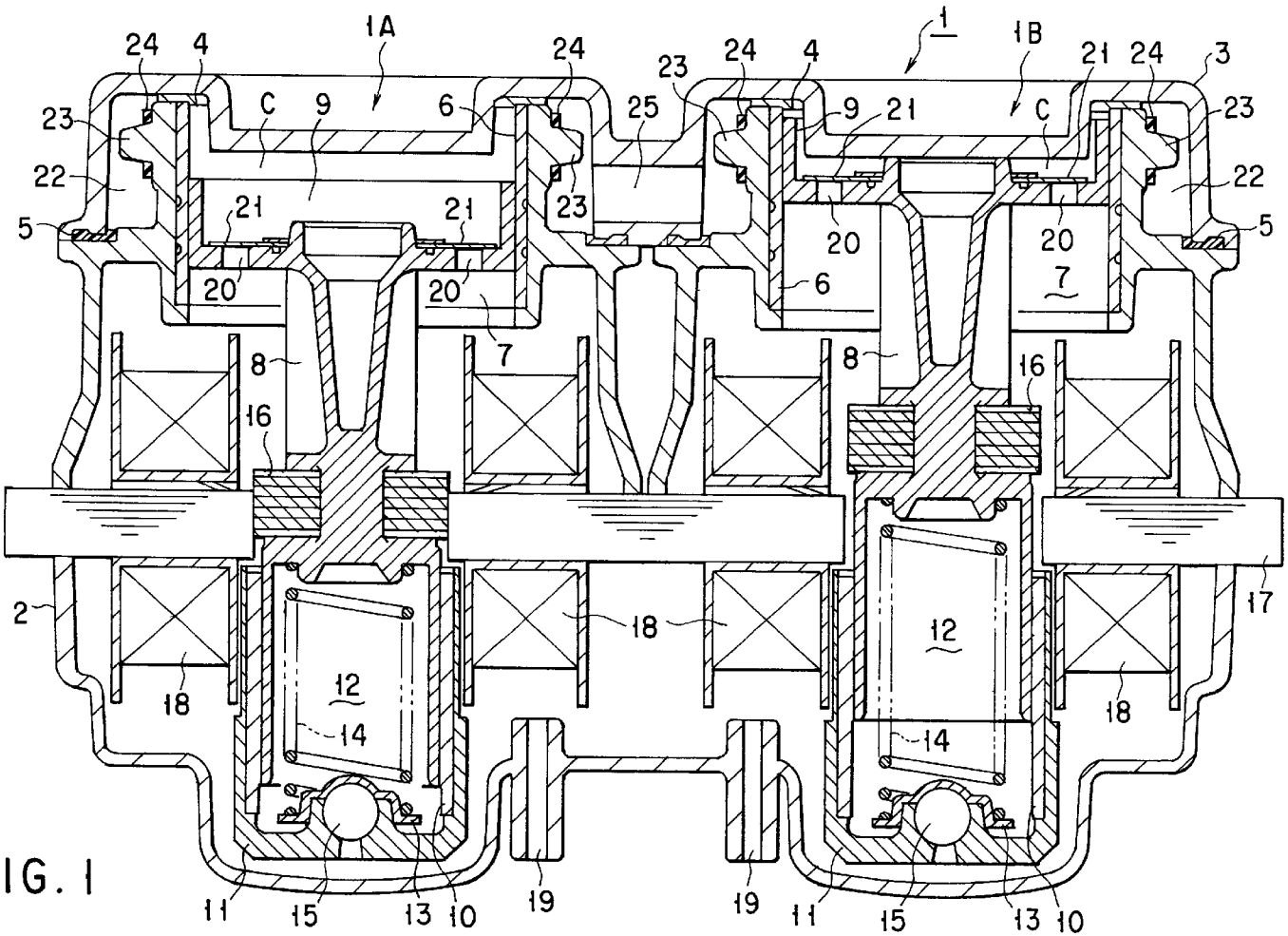
FIG. 1 is a cross-sectional view of a compressor having two compression portions according to a preferred embodiment of the present invention.

An embodiment according to the present invention will now be described hereinafter in detail with reference to the accompanying drawings. FIG. 1 is a cross-sectional view of an electromagnetic reciprocating compressor (which will be simply referred to as a "compressor" hereunder) according to one embodiment. In the drawing, a compressor 1 is configured in a double form having two compression portions 1A and 1B. An outer shape of the compressor 1 is defined by a casing 2 and a head cover 3 attached to the casing 2. A side on which the head cover 3 is provided will be referred to as a "front" portion of the compressor 1 and its opposed side will be referred to as a "rear" portion for the sake of convenience for explanation. Further, since the two compression portions 1A and 1B are similarly-constituted, like reference numerals denote like or corresponding parts. In particular, except those parts that differ, the structure and the operation will be described with reference to one compression portion.

Annular seal members 4 and 5 are sandwiched between the casing 2 and the head cover 3, and a sealed space surrounded by the head cover 3 and the casing 2 is formed. A front cylinder 7 having a cylindrical liner 6 is provided at the front portion of the casing 2, and a head 9 of a piston 8 is inserted into the front cylinder 7 so as to be capable of sliding. That is, a compression chamber C surrounded by the head cover 3, the front cylinder 7, and the head 9 of the piston 8 is defined.

A rear cylinder 11 having a cylindrical liner 10 is supported on the casing 2 by a non-illustrated support member at the rear of the casing 2. A skirt 12 of the piston 8 is inserted into the rear cylinder 11 so as to be capable of sliding. It is preferable that the skirt 12 has an cylindrical shape, and inside the skirt 12 is provided a compression coil spring 14 having one end being brought into contact with the bottom of the skirt 12 and the other end being brought into contact with the bottom of the rear cylinder 11 through a washer 13. With the rebound effect of the spring 14, the piston 8 is elastically pressed toward the front direction of the compressor 1. It is to be noted that the washer 13 is supported by a ball 15 so that the bounce of the spring 14 can smoothly act on the piston 8. An armature 16 is fixed to a neck, i.e., an intermediate portion of the piston 8, and the armature 16 and the piston 8 integrally move in the axial direction.

A field core (which will be simply referred to as a "core" hereinafter) 17 is provided at the casing 2, and a coil 18 is wound around the core 17 to form a magnetic pole of a fixed magnet. The core 17 is arranged in such a manner that its magnetic pole surrounds the piston 8 having the armature 16, and the armature 16 is attracted to the magnetic pole when the coil 18 is excited by the alternating electric current as will be described hereinafter. As shown in the drawing, the cores 17 provided for the two compression portions 1A and 1B are not provided so as to be separated from each other in accordance with the respective compression portions but integrally-constituted.

A intake port 19 for drawing a fluid (air) in is provided at the rear portion of the casing 2. On the other hand, a through hole 20 for leading the air taken from the intake port 19 into the compression chamber C is provided at the head 9 of the piston 8. A plate-like valve 21 which opens toward the front portion is provided at the front side of the through hole 20.

A sealed space surrounded by the external wall surface of the cylinder 7 and the inner surface of the head cover 3 forms a discharge chamber 22. A through hole (which will be described later with reference to FIG. 8) is also provided at the front cylinder 7 so that the air compressed in the compression chamber C can flow into the discharge chamber 22. A valve 24 held by a protruding valve holding portion 23 on the peripheral side of the front cylinder 7 is provided on the discharge chamber 22 side of this through hole. A through hole 25 is formed to the head cover 3, and the discharge chambers 22 and 22 of the compression portions 1A and 1B communicate with each other by the through hole 25 to form a continuous space.

Figure 2:
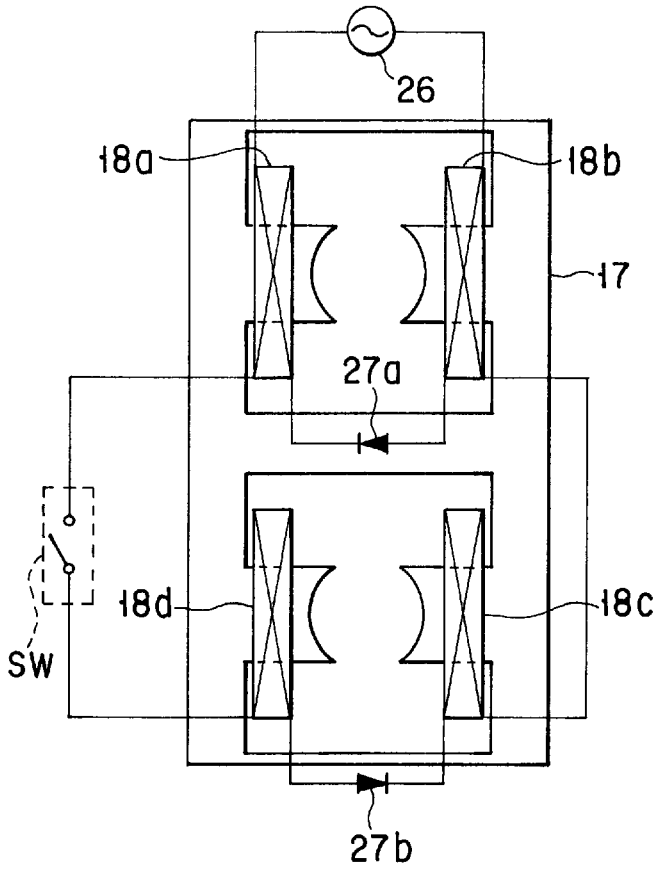
FIG. 2 is a wiring diagram of a power supply circuit for exciting a coil of a compressor according to the embodiment of the present invention.

FIG. 2 is a wiring diagram of a power supply circuit for exciting the coil 18. Coils 18*a* and 18*b* of the compression: portion 1A and coils 18*c* and 18*d* of the compression portion 1B are connected to an alternating power supply 26 which is, for example, a commercial power source in parallel. Further, a rectifier 27*a* is connected between the coils 18*a* and 18*b* and a rectifier 27*b* is connected between the coils 18*c* and 18*d*. However, the rectifiers 27*a* and 27*b* are connected so that their polarities are opposite to each other. With such wiring, the alternating power from the alternating power source 26 is half-wave-rectified, and the half-wave power is alternately supplied to the coils of the compression portions 1A and 1B.

With the above-described structure, in operation, a switch (not shown) is turned on, power is fed to the coil 18 of one of the compression portions 1A and 1B. Here, it is assumed that the compression portion 1A side is first excited by one half wave of the alternating electric current. When the power is fed to the coil 18, the part of the core 17 around which the coil 18 is wound, i.e., the magnetic pole is excited, and the armature 16 is attracted to the magnetic pole (the state of the compression portion 1A in FIG. 1). When the armature 16 is attracted to the magnetic pole, the piston 8 compresses the spring 14, enlarging the compression chamber C, thereby lowering the pressure. As a result, the valve 21 is opened, and the air within the casing 2 flows into the compression chamber C through the through hole 20.

When the compression portion 1A side is excited, since no electric current flows into the coil 18 on the compression portion 1B side, the piston 8 of the compression portion 1B is pressed toward the front direction by the spring 14. That is, at this moment, the air in the compression chamber C of the compression portion 1B is discharged into the discharge chamber 22.

The next half-wave electric current (the polarity is changed from the previous one) of the alternating power supply 26 is supplied to the coil 18 of the compression portion 1B. Consequently, the magnetic pole of the compression portion 1B is excited and, on the other hand, the magnetic pole of the compression portion 1A is demagnetized. Then, the piston 8 of the compression portion 1A is pressed toward the front portion by the spring 14, and the air in the compression chamber C is compressed. When the air pressure in the compression chamber C is increased and reaches a valve opening pressure of the valve 24, the air in the compression chamber C is discharged into the discharge chamber 22. When the magnetic pole of the compression portion 1A is demagnetized, the magnetic pole on the compression portion 1B side is excited, and the air is led into the compression chamber C.

The air discharged into the discharge chamber 22 is supplied to an external device (for example, a blower) from a non-illustrated discharge port provided at the head cover 3 constituting the discharge chamber 22, and used accordingly.

In this manner, the air is alternately drawn into the compression chambers 1A and 1B to be compressed, and alternately discharged into the discharge chamber 22. That is, when one of the compression portions 1A and 1B is in the air discharge stroke, the other is in the air compression stroke. Here, since the discharge chambers 22 and 22 of the compression portions 1A and 1B communicate with each other through the through hole 25, the air discharged by the discharge stroke of one compression portion can flow into the discharge chamber 22 of that compression portion as well as the discharge chamber 22 of the other compression portion. That is, as compared with a single compressor, the air is discharged into the discharge chamber having a double space. This means that the pulsation of the air discharged from the compression portions 1A and 1B is hardly transmitted to the outside by the extended discharge chamber 22. This functional effect will be described in detail in connection with an example of use of the compressor.

Figure 3A:
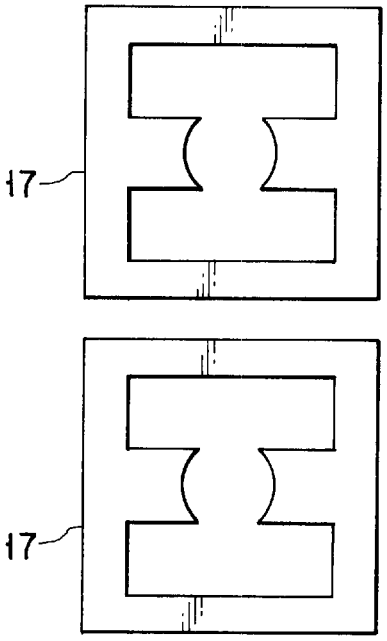
FIGS. 3A and 3B are plane views showing the shape of field cores.

In the above-mentioned compressor, the core 17 can be reduced in weight and size as compared with the conventional apparatus. That is, since the cores 17 for the two compression portions 1A and 1B are integrally formed, the core size can be reduced as compared with the case where the cores are separately provided with respect to each of the compression portions 1A and 1B. FIG. 3A is a plane view of cores separately formed in accordance with each of the two compression portions, and FIG. 3B is a plane view of the core of the compressor according to this embodiment.

Figure 3B:
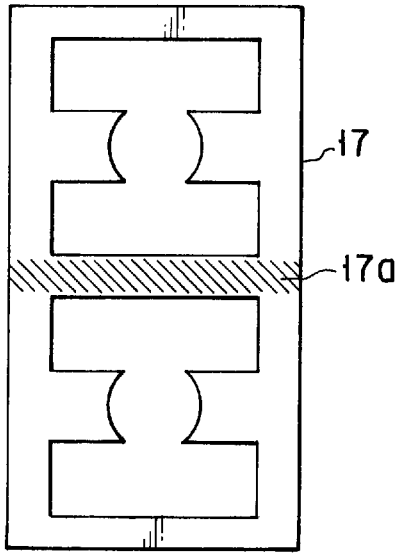

As can be understood from FIGS. 3A and 3B, in the core 17 according to this embodiment, since a portion 17*a* corresponding to the boundary between the two compression portions 1A and 1B can be commonly used, the amount of material for this portion 17*a* can be reduced, thereby reducing the weight or the size. Furthermore, since both of the compression portions 1A and 1B are not electrically energized at the same time, the capacity, i.e., the size capable of forming the magnetic path of one compression portion can suffice the portion 17*a*. It is noted that the core commonly used in the adjacent compression portions can be formed in this manner because the pistons of a plurality of the compression portions are arranged in parallel, and the core can not be commonly used by only integrally coupling a plurality of compressors in the linear or radial form as in the conventional apparatus disclosed in the above-described patent application.

Figure 4A:
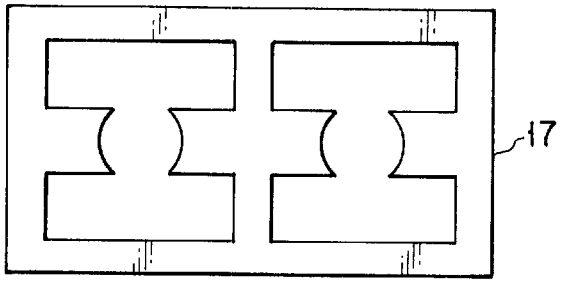
FIGS. 4A to 4D are plane views showing modifications of the field core.
Figure 4B:
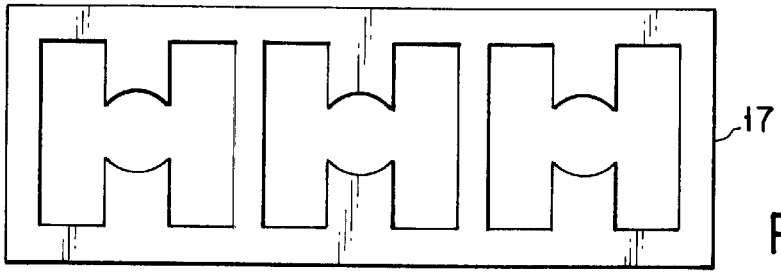
Figure 4C:
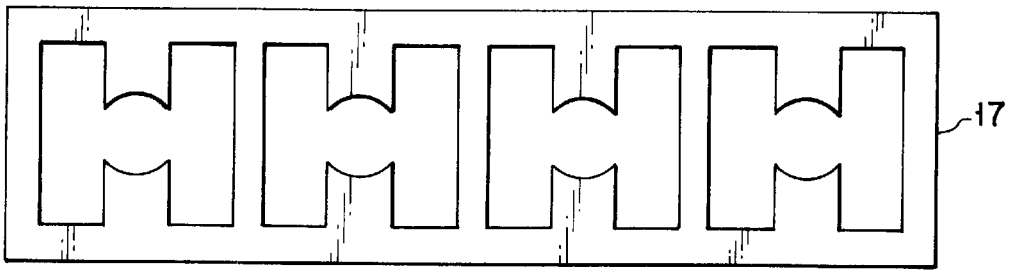
Figure 4D:
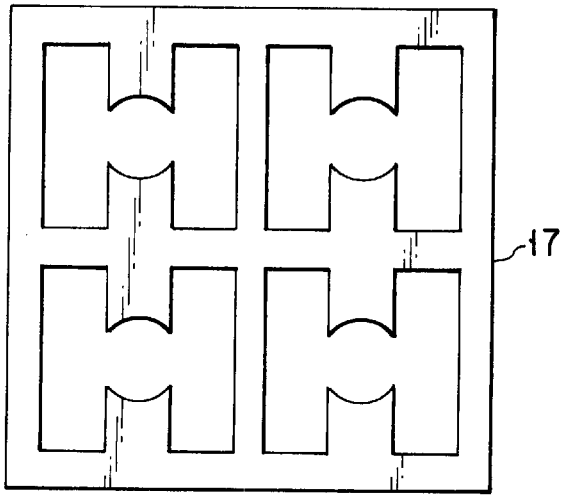

The shape of the core 17 can be modified as follows. FIGS. 4A to 4D are plane views showing modifications to the core. FIG. 4A is a view showing the core with a double structure in which a direction of the magnetic pole is different from that in FIG. 3B 90°; FIG. 4B, a core with a triple structure in which three compression portions are provided; and FIG. 4C, a core with a quadruple structure in which four compression portions are provided. Furthermore, FIG. 4D is a plane view of the core showing an example in which the compression portions are not arranged in one row but in two directions. As described above, when a plurality of compression portions are coupled with each other; the amount of material for the core 17 corresponding to each boundary portion can be reduced. Moreover, the number of compression portions can be increased or decreased according to need.

Figure 5:
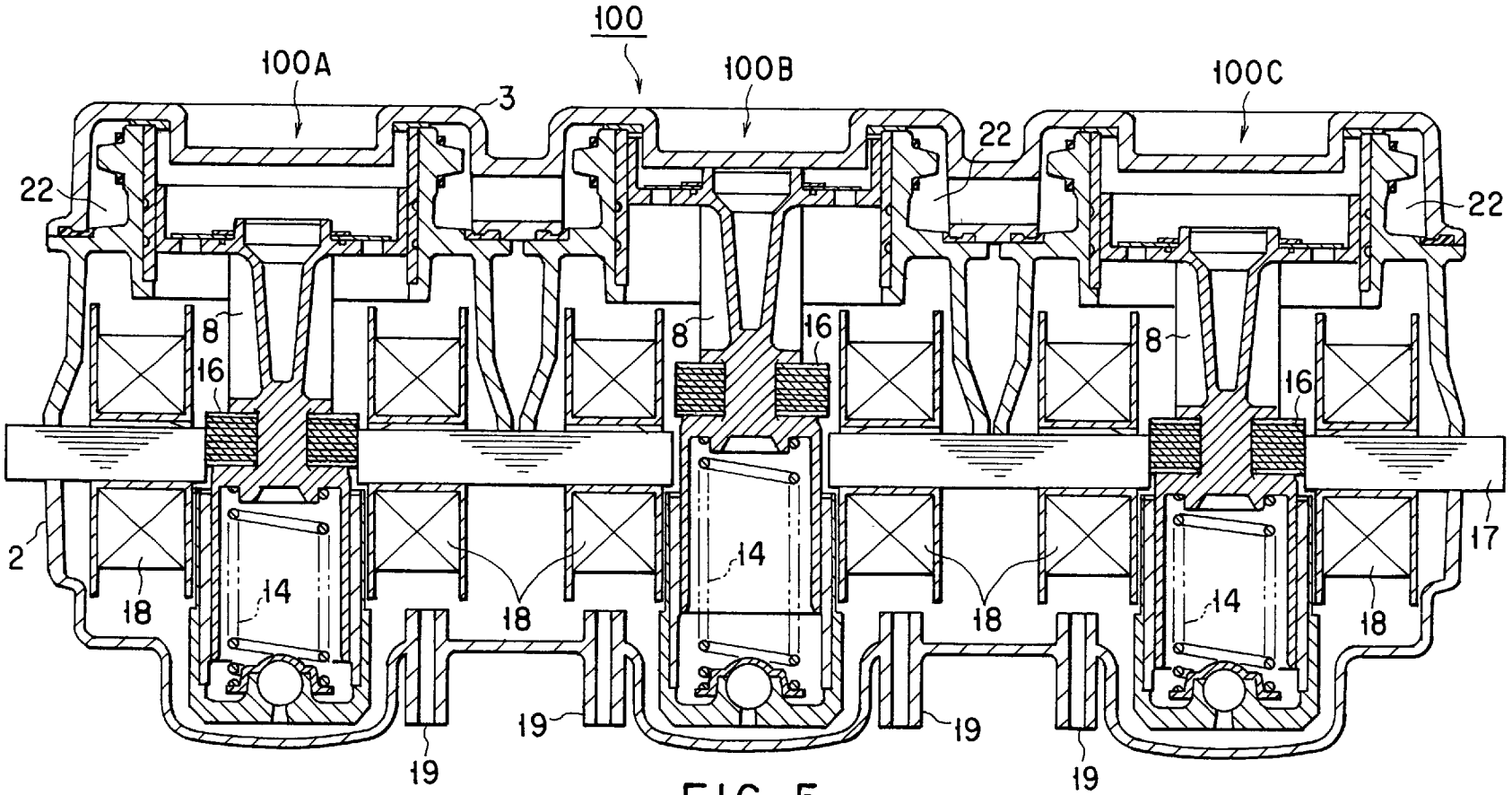
FIG. 5 is a cross-sectional view of a compressor having three compression portions.

FIG. 5 is a cross-sectional view of the compressor 100 having three compression portions. If the number of compression portions is three, since the basic structure or operation is similar to that of the compressor 1 shown in FIG. 1, a detailed explanation is unnecessary. In the case of three compression portions, the alternating power supply 26 is connected to the three compression portions in parallel. However, rectifiers similar to the rectifiers 27*a* and 27*b* are connected and coupled in such a manner that one half-wave electric current energizes one of the three compression portions, and the other half-wave electric current energizes the remaining two compression portions. In the example of FIG. 5, the compression portions 100A And 100C are simultaneously energized by one half-wave electric current, and the compression portion 100B is energized by the other half-wave electric current. That is, the pistons 8 reciprocate in directions different from each other by 180° in the compression portions 100A and 100C and in the compression portion 100B.

As described above, since a plurality of compression portions are integrally-coupled with each other and the included pistons S are pressed in directions different from each other by 180°, vibrations caused by the reciprocating motion of the pistons can be canceled out, thereby suppressing them.

Figure 6:
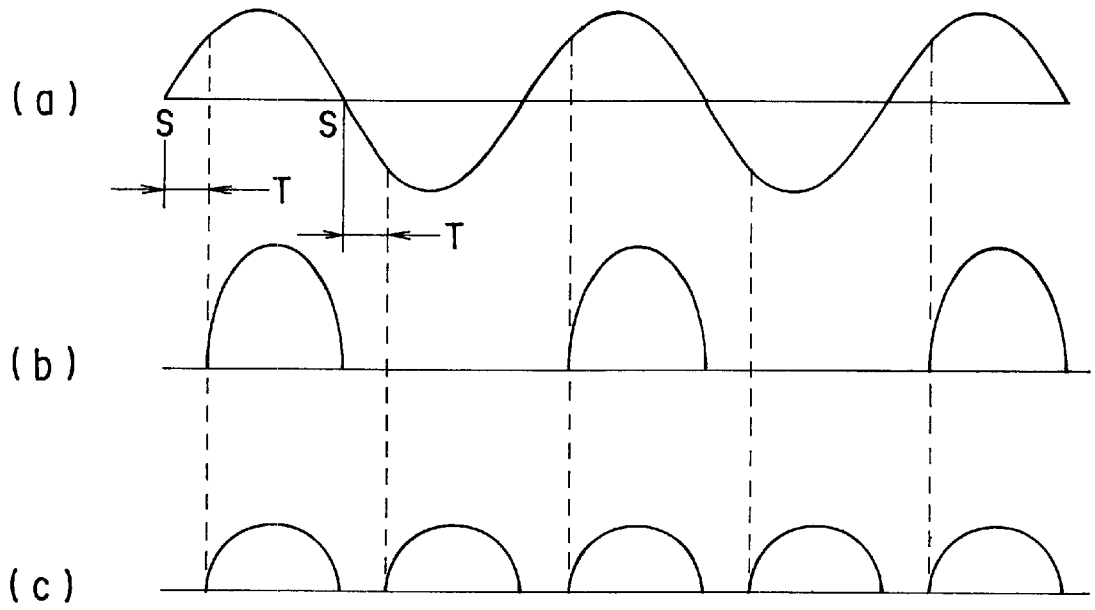
FIG. 6 is a type drawing showing a mode of pulsation when discharging a compressed fluid.

As mentioned above, since the discharge chamber is substantially extended, pulsation is eased. Moreover, when a plurality of compression portions are alternately-energized by the alternating electric current every half wave, pulsation is low for a discharge quantity. This will now be described with reference to the drawing. FIG. 6 is a view showing the relationship between the alternating electric current and the discharge quantity. In the drawing, (a) is an alternating waveform inputted to the compressor; (b), a discharge quantity in a conventional compressor having a single compression portion; and (c), a discharge quantity in the compressor having the two compression portions according to this embodiment, respectively. After a time T passes from a point in time S at which the magnetic pole is demagnetized, the valve 24 of the compression chamber C is opened when the pressure reaches a valve opening pressure, and the compressed air is discharged.

As shown in the drawing, in the conventional compressor, a large quantity of fluid is discharged in a cycle according to an alternating frequency. On the other hand, in the compressor according to this embodiment, the fluid whose quantity is half of a desired quantity is discharged in accordance with the alternating frequency every half wave, i.e., in a ½ cycle of the frequency. As a result, in this embodiment, similar to the relationship of the discharge quantity, the discharge pulsation has a small amplitude and a short cycle.

Figure 7:
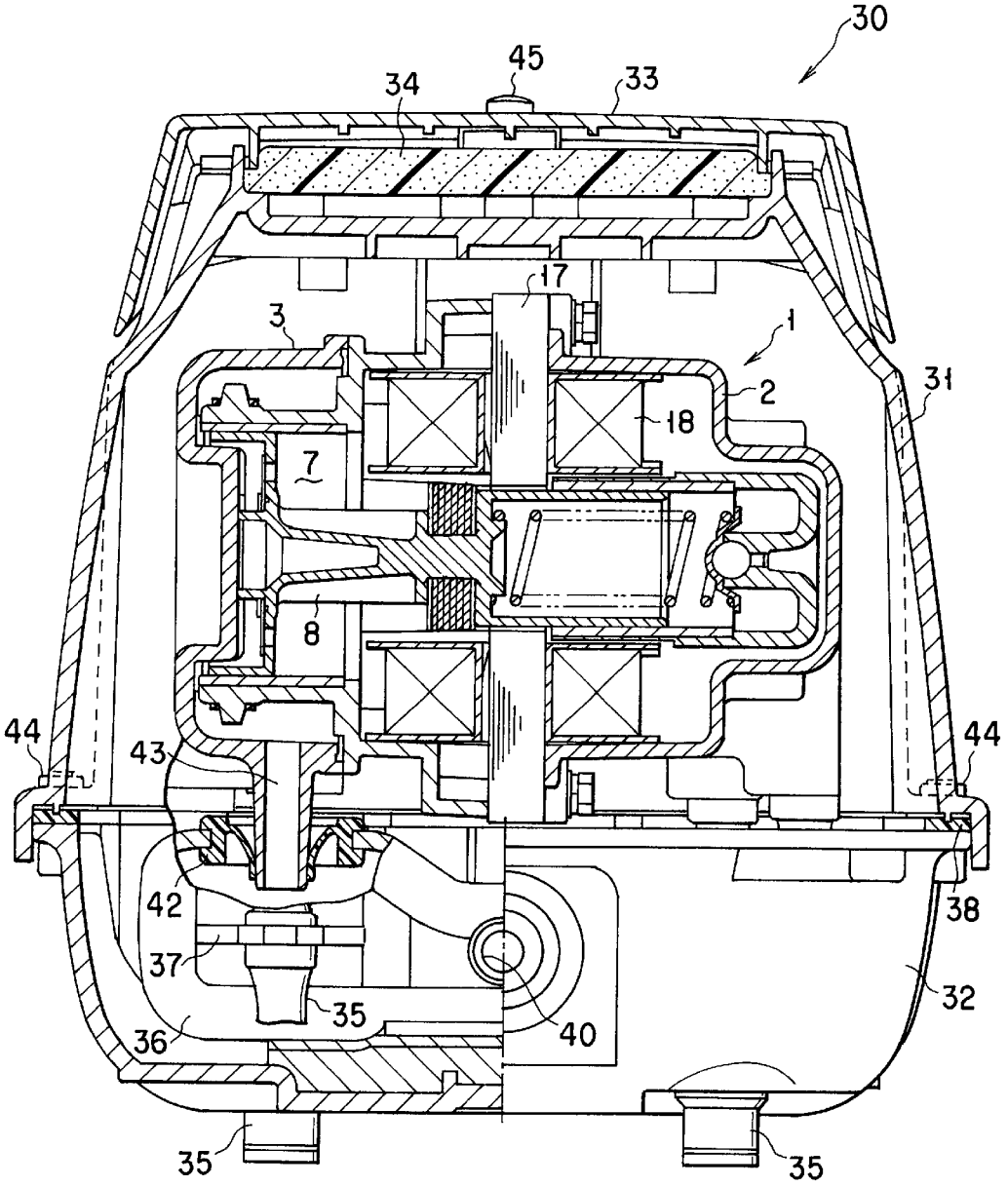
FIG. 7 is a side cross-sectional view showing a blower to which a compressor including two compression portions is applied.
Figure 8:
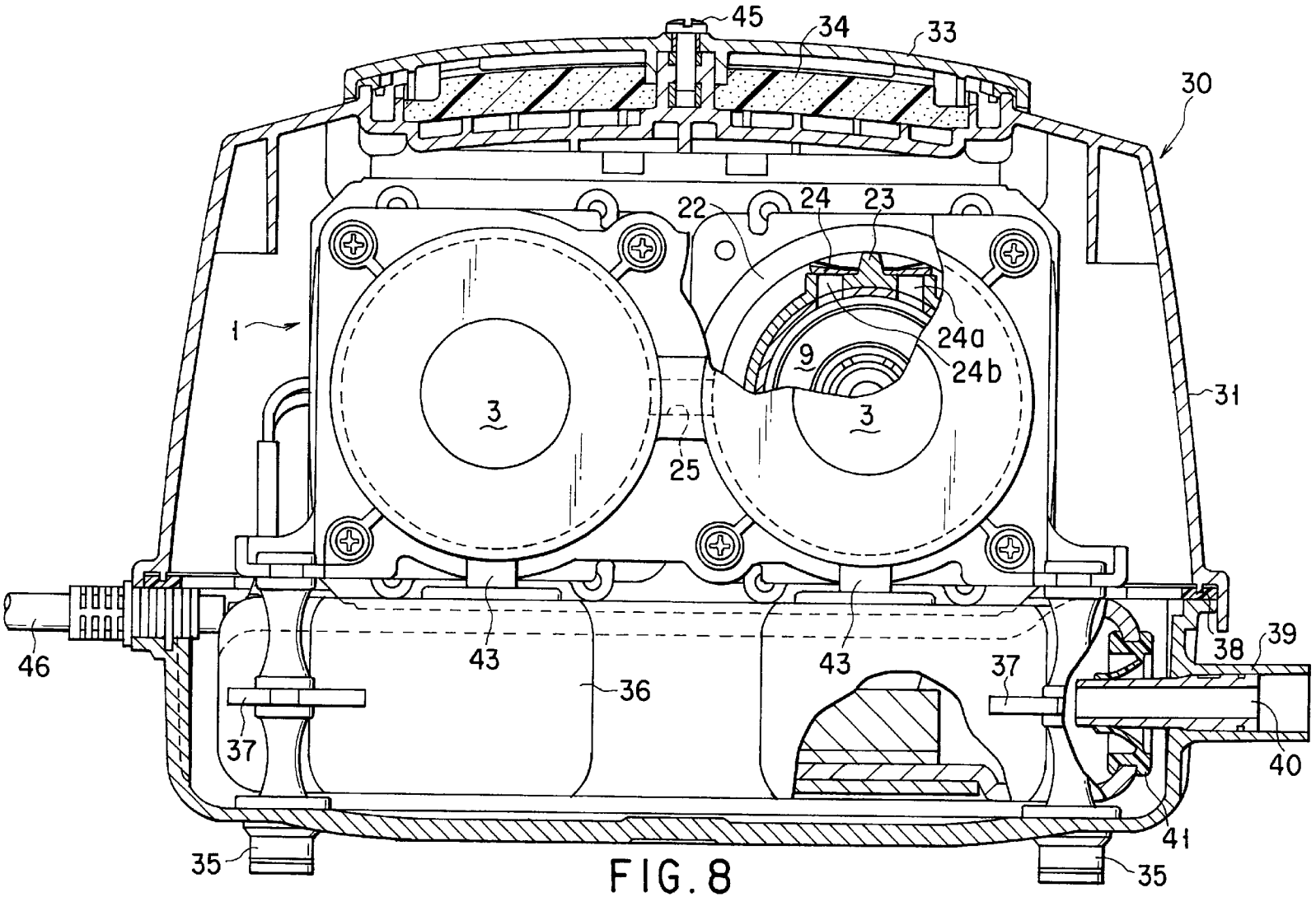
FIG. 8 is a front cross-sectional view showing the blower to which a compressor including two compression portions is applied.

A description will now be given as to a blower as a device using the above-mentioned compressor. FIG. 7 is a side cross-sectional view of the blower consisting of a compressor including two compression portions, and FIG. 8 is a front cross-sectional view of the blower. In the both drawings, like reference numerals denote like or corresponding parts. In addition, reference numerals are given only to primary parts in the compressor 1 in order to clarify the drawings. Incidentally, the piston of the compressor 1 moves in the horizontal direction in this blower 30, which is different in arrangement direction from the compressor shown in FIG. 1 in which the piston moves in the vertical direction. However, the basic structure and function are the same. The blower 30 includes a housing which has an upper case 31, a bottom case 32 and a cap 33 over the upper case 31. The compressor 1 having the two compression portions is accommodated in this housing and can withstand outdoor use. A filter 34 is provided between the upper case 31 and the cap 33.

A leg 35 penetrating through the bottom of the bottom case 32 to be supported is provided to the bottom case 32. The intermediate portion of the leg 35 is engaged with a projecting portion 37 of an air tank 36 to fix the air tank 36 in the bottom case 32. Additionally, a head portion of the leg 35 is engaged with the casing 2 and the head cover 3 of the compressor 1 which are arranged on the top of the air tank 36 to fix the compressor 1 at a desired position. A seal member (packing) 38 for maintaining air-tightness is provided at the gathering portion of the upper case 31 and the bottom case 32. It is preferable to manufacture the leg 35 supporting the air tank 36 and the compressor 1 by using an elastic member such as rubber in light of vibration absorption.

A nozzle 39 for supplying the air accumulated in the air tank 36 to an external portion is provided on the side wall of the bottom case 32. An inner nozzle 40 is externally inserted into the nozzle 39, and the end of the inner nozzle 40 is engaged with a bush 41 fitted into an opening provided on the side wall of the air tank 36. The bush 41 has an elastic annular rib 41*a* formed at the center thereof, and the annular rib 41a is constituted so as to air-tightly contact around the inner nozzle 40, thereby assuring air-tightness between the bush 41 and the inner nozzle 40.

An opening is also provided on the top of the air tank 36, and a bush 42 similar to the bush 41 is fitted in this opening. The end of a discharge nozzle 43 provided so as to downwardly protrude from the head cover 3 of the compressor 1 is engaged with the bush 42.

Through holes 24*a* and 24*b* opened/closed by the valve 24 are formed on the cylinder 7 of the compressor 1 (FIG. 8). The compressed air is discharged to the discharge chamber 22 through the through holes 24*a* and 24*b*.

When assembling the blower 30, the leg 35 is first attached to the bottom case 32, and the air tank 36 is then set to the bottom case 32 to be fixed to the leg 35. Subsequently, the inner nozzle 40 is inserted toward the inside from the nozzle 39, and its end is fitted into the center of the bush 41. Then, the compressor 1 is mounted from the upper side and fixed to the head portion of the leg 35. At this time, the discharge nozzle 43 is fitted in the center of the bush 42.

After the air tank 36 and the compressor 1 are fixed at desired positions, the bottom case 32 and the upper case 31 are assembled through the packing 38. At last, the filter 34 is set on the upper case 31 and the cap 33 is put thereon. The upper case 31 is fixed to the bottom case 32 by a setscrew 44, and the cap 33 is fixed to the upper case 31 by a setscrew 45. It is to be noted that a cable 46 for feeding power to the coil 18 is pulled out from the side wall of the bottom case 32.

In the operation of the blower 30, when the compressor 1 is started up, the outside air is taken from the space between the upper case 31 and the cap 33. The external air drawn in passes through the filter 34 from the upper side to the lower side and reaches the circumference of the compressor 1. Then, external air is sucked in and compressed by the compressor 1 and accumulated in the air tank 36 through the discharge nozzle 43. The accumulated compressed air is supplied from the nozzle 39 according to need. Pulsation of the air caused by the operation of the compressor 1 is absorbed by the air tank 36 and smoothed. Here, since the discharge chamber 22 having a large capacity absorbs pulsations similar to the air tank 36, the capacity of the air tank 36 can be thereby reduced.

In this way, in the compressor according to this embodiment, the magnetic circuit in the form of the core 17 is commonly used by a plurality of compression portions to improve the efficiency, and the size of the air tank for reducing the pulsation is decreased when the compressor is used as, e.g., a blower, thereby facilitating a reduction in overall size. Further, since the full wave of the alternating electric current supplied from the alternating power supply can be used, the power can be more effectively utilized, and the full wave can be used to alternately reciprocate the pistons in opposed directions, thereby reducing vibrations.

As described above, the compressor according to this embodiment, namely, a compact compressor for obtaining a large discharge quantity can be realized. Further, when a switch is provided in the wiring of the coil wound around the core so as to be capable of selectively energizing any one of a plurality of compression portions, the discharge quantity can be controlled. For example, in FIG. 2, a switch SW for controlling the discharge quantity can be provided to the wire connecting the power supply 26 to the coil 18*d*. When this switch SW is opened, the discharge quantity can be reduced to half that of the quantity when the switch SW is closed.

As is apparent from the above description, according to the present invention, since a plurality of compression portions are provided, the discharge quantity can be increased. Furthermore, irrespective of the increase in the discharge quantity, a reduction in size and weight can be achieved by commonly using the field core. Moreover, since the discharge chamber can be substantially enlarged, pulsation can be suppressed.

In addition, when the blower is formed by using this compressor, the capacity of the tank accommodating the fluid compressed in each compression portion can be reduced, thereby further decreasing the size.

Additionally, control of the discharge quantity can be facilitated by operating only the piston connected by the switch means among the pistons in the multiple compression portions.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electromagnetic reciprocating compressor comprising:

a casing; and a plurality of fluid compression portions which are arranged in said casing, each of which has a piston, and which are arranged in such a manner that said pistons can move in directions parallel to each other, each of said compression portions having: a cylinder for accommodating said piston so as to be capable of reciprocating; a compression chamber defined by the piston for compressing a fluid; a spring for urging said piston in a direction for compressing said fluid in said compression chamber; one field core having a pair of opposed portions forming magnetic poles oppositely arranged along the diametral direction of said piston; a coil which is wound around said field core and moves said piston against the urging force of said spring when excited; and a discharge chamber for receiving said compressed fluid from said compression chamber when said coil is demagnetized, said compressor further comprising passage means which is provided in said casing and communicates said discharge chambers of said respective compression portions, said field core of said each compression portion being integrally formed so that a boundary portion can be commonly used with a field core of an adjacent compression portion, and at least one of a plurality of said field cores including a power supply device for supplying a half wave of an alternating electric current to said coil in such a manner that an excitation direction is opposed to that of at least a different one of said plurality of said field cores.

2. The compressor according to claim 1, further comprising a head cover which covers said cylinder and defines said compression chamber in said cylinder with said piston, wherein said discharge chamber is formed of an air-tight chamber defined by said head cover on the outer periphery of said cylinder, said passage means for integrally communicating said respective discharge chambers being formed of a through hole provided to said head cover.

3. The compressor according to claim 1, wherein said power supply device has switch means for selectively driving a predetermined number of pistons among said pistons of a plurality of said compression portions.

4. The compressor according to claim 1, wherein a plurality of said fluid compression portions are linearly aligned.

5. The compressor according to claim 1, wherein a plurality of said fluid compression portions are aligned into rows and columns.

6. A blower including an electromagnetic reciprocating compressor in a housing, said compressor comprising:

a casing; and a plurality of fluid compression portions which are arranged in said casing, each of which has a piston, and which are arranged in such a manner that said pistons can move in directions parallel to each other, each of said compression portions having: a cylinder for accommodating said piston so as to be capable of reciprocating; a piston defining a compression chamber for compressing a fluid; a spring for giving impetus to said piston in a direction for compressing said fluid in said compression chamber; one field core having a pair of opposed portions forming magnetic poles oppositely arranged along the diametral direction of said piston; a coil which is wound around said field core and moves said piston against the urging force of said spring when excited; and a discharge chamber for receiving said compression fluid from said compression chamber when said coil is demagnetized, said field core of said each compression portion being integrally formed so that a boundary portion can be commonly used with a field core of an adjacent compression portion, said compressor further comprising:

a power supply device for supplying a half wave of an alternating electric current to said coil in such a manner that at least one of a plurality of said field cores has an excitation direction opposed from that of at least a different one of said plurality of said field cores; and a head cover which covers said cylinder and is attached to said casing, defines said compression chamber in said cylinder with said piston, defines said discharge chamber having an air-tight structure at the outside of said each cylinder, and has a passage communicating said discharge chambers with each other and a nozzle protruding toward the outside and communicating said discharge chambers with the outside, said blower further comprising:

a tank arranged in said housing; and a bush which is formed in said tank and accepts said nozzle in the sealed state, said fluid compressed in said each compression chamber being received in said tank.

7. The blower according to claim 6, wherein said power supply device has switch means for selectively driving a predetermined number of pistons among said pistons of a plurality of said compression portions.

8. The blower according to claim 6, further comprising a nozzle provided so as to penetrate said housing and a second bush provided to said tank in order to accommodate said nozzle, thereby supplying said fluid in said tank to the outside.

9. The blower according to claim 6, wherein said fluid is air.

* * * * *